US009222053B2

(12) United States Patent
Ikai

(10) Patent No.: US 9,222,053 B2
(45) Date of Patent: Dec. 29, 2015

(54) LUBRICATING COMPOSITION

(75) Inventor: Toru Ikai, Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/383,878

(22) PCT Filed: Jun. 29, 2010

(86) PCT No.: PCT/EP2010/059239

§ 371 (c)(1),
(2), (4) Date: Feb. 8, 2012

(87) PCT Pub. No.: WO2011/006755

PCT Pub. Date: Jan. 20, 2011

(65) Prior Publication Data

US 2012/0142568 A1 Jun. 7, 2012

(30) Foreign Application Priority Data

Jul. 15, 2009 (JP) ..... 2009-166568

(51) Int. Cl.
*C10M 157/00* (2006.01)
*C10M 145/14* (2006.01)

(52) U.S. Cl.
CPC ..... *C10M 145/14* (2013.01); *C10M 2203/06* (2013.01); *C10M 2203/104* (2013.01); *C10M 2209/04* (2013.01); *C10M 2223/047* (2013.01); *C10N 2220/021* (2013.01); *C10N 2220/022* (2013.01); *C10N 2220/032* (2013.01); *C10N 2230/06* (2013.01); *C10N 2230/58* (2013.01); *C10N 2240/02* (2013.01); *C10N 2240/04* (2013.01)

(58) Field of Classification Search
CPC ..... C10M 2203/1006; C10M 2203/1025; C10M 2205/173; C10M 2209/084; C10M 2205/04
USPC ..... 508/473, 469
See application file for complete search history.

(56) References Cited

U.S. PATENT DOCUMENTS

| | | | | |
|---|---|---|---|---|
| 2003/0104955 | A1 | 6/2003 | Yuki | |
| 2004/0077509 | A1 | 4/2004 | Yuki et al. | 508/469 |
| 2008/0015400 | A1 | 1/2008 | Matsui | |
| 2008/0248981 | A1 | 10/2008 | Matsui | |
| 2010/0093578 | A1* | 4/2010 | Tsujimoto et al. | 508/430 |

FOREIGN PATENT DOCUMENTS

| | | | | |
|---|---|---|---|---|
| CN | 1962835 | | 5/2007 | |
| EP | 2009074 | A1 | 12/2008 | |
| EP | 2039746 | A1 | 3/2009 | |
| JP | 2004149794 | A | 5/2004 | |
| JP | 2005002213 | A | 1/2005 | |
| JP | 2005307197 | A | 11/2005 | |
| JP | 2006077119 | A | 3/2006 | |
| JP | 2008133440 | | 6/2008 | C10M 135/06 |
| JP | 2008179669 | | 8/2008 | C10M 101/02 |
| JP | 2009007562 | A | 1/2009 | |
| WO | WO2008053033 | | 5/2008 | |
| WO | WO2008090179 | | 7/2008 | C10M 141/08 |

OTHER PUBLICATIONS

Hamrock, B.J. et al.; "Isothermal Elastohydrodynamic Lubrication of Point Contacts"; Journal of Lubrication Technology; Transactions of the ASME; pp. 264-276; Apr. 1977.

Fan, J. et al., 'Reduction of Friction by Functionalised Viscosity Index Improvers', Tribol Lett (2007) vol. 28, pp. 287-298.

CCPIT Patent & Trademark Law Office, First Office Action dated Dec. 12, 2012, IIC120029, Chinese Application No. 201080038474.5.

* cited by examiner

*Primary Examiner* — Vishal Vasisth

(57) ABSTRACT

The present invention provides a lubricating composition comprising a base oil (A) and a hydroxyl group-added poly (meth)acrylate (B).

4 Claims, No Drawings

LUBRICATING COMPOSITION

CROSS REFERENCE TO EARLIER APPLICATIONS

The present application is a national stage application of International application No. PCT/EP2010/059239, filed 29 Jun. 2010, which claims priority of JP 2009-166568, filed in the Japanese patent office on 15 Jul. 2009.

FIELD OF THE INVENTION

This invention relates to a lubricating composition for use in rolling contact or rolling and sliding contact systems such as roller bearings and gears, and in particular it relates to a lubricating composition for use in rolling contact or rolling and sliding contact systems where a load (weight) is applied.

BACKGROUND OF THE INVENTION

There have been various investigations of lubricating compositions intended to improve the functioning of machines which are in contact in harsh environments of high speeds and large loads. For example, Japanese Laid-open Patent 2008-133440 proposes a lubricating composition which can be used in transmissions where increasing compactness has created conditions of running at high speeds and high loads. This lubricating composition incorporates, in base oils which are mineral oils and/or synthetic oils, metal dithiophosphates and poly(meth)acrylates which contain hydroxyl groups. Its anti-seizing performance is good, and it is possible to obtain a lubricating composition which has extreme-pressure properties the same as or better than with sulphur-phosphorus based additives, low fatigue characteristics, high oxidative stability and the prospect of longer life. A satisfactory lubricating composition can be obtained even under conditions where transmissions have been made more compact and are also running under high speeds and high loads.

However, lubrication mechanisms in rolling contact or rolling and sliding contact systems where a load (weight) is applied have aspects that are different from transmissions, and these mechanisms have been under investigation. For example, in Tribology Transactions, Vol. 53, 2010, page 658 it has been shown that a lubricating composition which forms an EHL (Elasto-Hydrodynamic Lubrication) oil film and so prevents interference between protuberances on sliding surfaces can be used as a lubricating composition for use in rolling contact or rolling-sliding contact systems such as roller bearings or gears, and especially as a lubricating composition for use in rolling contact or rolling-sliding contact systems under a load (weight).

According to Tribology Transactions, Vol. 53, 2010, page 658, the important elements in a lubricating composition which forms an EHL oil film are the minimum oil film thickness in line contact and the pressure-viscosity coefficient. The minimum oil film thickness is the minimum oil film thickness of the line contact gap, and so is the minimum thickness of the film of oil that is present in the line contact gap. It signifies the minimum condition for maintaining lubrication. The pressure-viscosity coefficient is a coefficient showing the relationship between the pressure applied in the contact system and the viscosity of the lubricating composition. It is the numerical value expressed by a in the Hamrock-Dowson formula, and the larger the value the higher the viscosity as the pressure increases. It shows a trend whereby a high oil film thickness is maintained under elasto-hydrodynamic lubricating conditions.

In Journal of Lubrication Technology, Transactions of ASME, 99 (April), 264 (1977) it is also disclosed that a lubricating composition which forms an EHL (elasto-hydrodynamic lubrication) oil film plays a role in preventing interference between protuberances on sliding surfaces in roller bearings, and the Hamrock-Dowson formula relating to point contact minimum oil thickness (Hmin: dimensionless minimum oil film thickness) and central oil film thickness (Hc: dimensionless central oil film thickness) is shown.

As a specific example of a lubricating composition which can be used in the bearings of high-speed main spindles having ceramic ball roller-bearings run in harsh environments of high speeds and large loads in the high-speed machining centres which process aeroplane parts and in particular metals such as titanium, there is the lubricating composition for use in ceramic lubrication proposed in Japanese Laid-open Patent 2008-179669. In this lubricating composition a base oil, being at least one kind of oil selected from mineral oils and/or synthetic oils, contains at least one kind of additive selected from the group consisting of acid amides obtained by reacting amines with saturated monocarboxylic acids of 12 to 30 carbons or unsaturated monocarboxylic acids of 18 to 24 carbons, sarcosinic acids, aspartic acid derivatives or succinic acid derivatives. If it is used even in the high-speed main spindles of machine tools which have ceramic ball roller-bearings run in harsh environments of high speeds and large loads, it displays satisfactory cooling properties and has good rust prevention, a high level of thermal and oxidative stability, and high extreme-pressure properties.

SUMMARY OF THE INVENTION

In order to obtain superior lubrication performance in response to changing conditions of use, it is necessary to change the compounding of the additive. The objective of this invention is therefore to resolve the aforementioned problems of the prior art by offering, as a lubricating composition for use in rolling contact or rolling and sliding contact systems such as roller bearings and gears, and in particular a lubricating composition for use in rolling contact or rolling and sliding contact systems where a load (weight) is applied, a lubricating composition which uses additives different from the prior art, and has a large minimum oil film thickness, a high pressure-viscosity coefficient and a large pressure-velocity product (PV value).

This invention relates to the following.

(1) A lubricating composition comprising a base oil (A) and a hydroxyl group-added poly(meth)acrylate (B).

(2) A lubricating composition in accordance with the aforementioned (1) which further contains an alkyl naphthalene (C).

(3) A lubricating composition in accordance with the aforementioned (1) or (2) which further contains a phosphorus-containing carboxylic acid compound (D).

(4) A lubricating composition in accordance with any of the aforementioned (1) to (3) in which the base oil (A) has a % CA of not more than 10 and a ratio of % CN and % CP (% CN % CP) of not less than 0.4.

(5) A lubricating composition in accordance with any of the aforementioned (1) to (4) which contains, in terms of the total amount, 70 to 99.5% by mass of base oil (A) and 0.5 to 30% by mass of hydroxyl group-added poly(meth)acrylate (B).

(6) A lubricating composition in accordance with any of the aforementioned (2) to (5) which contains, in terms of the total amount, 0 to 10% by mass of alkyl naphthalene (C).

(7) A lubricating composition in accordance with any of the aforementioned (3) to (6) which contains, in terms of the total amount, 0 to 1.0% by mass of phosphorus-containing carboxylic acid compound (D).

(8) A lubricating composition in accordance with any of the aforementioned (1) to (7) for use in rolling contact or rolling and sliding contact systems.

DETAILED DESCRIPTION OF THE INVENTION

The lubricating composition forming the subject of this invention is a lubricating composition for use in rolling contact or rolling and sliding contact systems such as roller bearings and gears, and in particular a lubricating composition for use in rolling contact or rolling and sliding contact systems where a load (weight) is applied. The elements subject to lubrication in the spindles, bearing members and bearing parts which constitute the rolling contact or rolling-sliding contact systems are lubricated elements comprised of materials such as the irons and steels and ceramics as generally used in rolling contact or rolling-sliding contact systems such as roller bearings and gears, but there is particular applicability to oils for high-speed bearings in contact systems which contain ceramics.

The % CA of the base oil (A) used in this invention is preferably not more than 10, but is preferably not more than 5 and more preferably not more than 1. If the % CA of the lubricating base oil exceeds the aforementioned upper limit, the viscosity-temperature characteristics, thermal and oxidative stability and friction characteristics are reduced. By making the % CA of the lubricating composition base oil relating to this invention at least 1, it is possible to increase the solubility of additives, but the % CA may also be 0.

The % CN/% CP of the base oil (A) is, as mentioned above, preferably not less than 0.4, but is preferably not less than 0.5. If the % CN/% CP is less than the aforementioned lower limit, the pressure-viscosity coefficient which relates to anti-wear properties and oil film formation properties will be reduced.

Further, the % CN of the base oil (A) is preferably 30 to 60, more preferably 30 to 50, and even more preferably 30 to 40. If the % CN of the lubricating composition base oil is more than the aforementioned upper limit of 60 or less than the aforementioned lower limit of 30, there will be a tendency for the pressure-viscosity coefficient which relates to anti-wear properties and oil film formation properties to decrease.

What is meant by % CP, % CN and % CA in this invention are the percentages obtained by the method of ASTM D-3238-85 (n-d-M ring analysis), and they refer to the percentage of the number of paraffin carbons relative to the total number of carbons, the percentage of the number of naphthene carbons relative to the total number of carbons, and the percentage of the number of aromatic carbons relative to the total number of carbons. In other words, the preferred ranges for the above-mentioned % CP, % CN and % CA are based on values obtained by the aforementioned method, and even if, for example, a lubricating composition base oil does not contain a naphthenic component it may still show a value where % CN obtained by the aforementioned method exceeds 0.

It is possible to use for the base oil (A) of this invention those of the aforementioned composition from base oils used as the base oils of lubricating compositions. There is no restriction as to origin, refining method or the like. The base oils that can be used are the mineral oils known as highly refined base oils and synthetic oils. Since the base oils that belong to API (American Petroleum Institute) base oil categories of Group I, Group II, Group III, Group IV and Group V may or may not fall within the aforementioned ranges of composition, it is possible to select one kind alone from the base oils belonging thereto or a mixture of several kinds for use as the base oil of this invention.

Good examples of the base oil (A) for use in this invention are those with a density at 15° C. of from 0.75 to 0.95 g/cm$^3$, but preferably from 0.80 to 0.90 g/cm$^3$. Good examples are those with a 40° C. kinematic viscosity of from 1.7 to 100 mm$^2$/s, but preferably from 2 to 68 mm$^2$/s, a number average molecular weight of from 140 to 590 but preferably from 170 to 500, and a 100° C. kinematic viscosity of from 0.75 to 20 mm$^2$/s but preferably from 1 to 8 mm$^2$/s, and the viscosity index may be selected freely according to the objective, but will be from 20 to 160 and preferably from 40 to 130.

Particularly suitable as the base oil (A) for use in this invention are those in which the central oil film thickness at 80° C., measured by means of an optical type EHL oil film thickness measuring device, is not less than 150 nm, and preferably not less than 160 nm. The method of measuring the central oil film thickness is the method described later.

In the case of the base oil (A) for use in this invention, those which have a pressure-viscosity coefficient (average) at 80° C., calculated from the central oil film thickness measured by means of an optical type EHL oil film thickness measuring device, of not less than 13 GPa$^{-1}$, and preferably not less than 14 GPa$^{-1}$, have a large central oil film thickness and can increase the pressure-viscosity coefficient and increase the pressure-velocity product (PV value), and so are suitable as a base oil (A) for use in lubricating compositions for use in high-speed main spindles. The method of calculating the pressure-viscosity coefficient is the method described later.

The important factor which influences lubrication properties is the "minimum oil film thickness (Hmin)" formed on the lubrication surface. There are several methods for measuring the oil film thickness, and the measured values which can be measured are the "minimum oil film thickness (Hmin)", the "central oil film thickness (Hc)" and so on. Of these, the "minimum oil film thickness (Hmin") is the oil film thickness of the area where the oil film formed on the lubrication area is the minimum thickness, and a procedure is necessary to find the area of minimum thickness from data obtained by means of measurements. In contrast, the "central oil film thickness (Hc)" is the oil film thickness obtained as is from data for the central area of ball contact. The procedure is simpler and measurements can be taken in a shorter time. As described in Journal of Lubrication Technology, Transactions of ASM, 99 (April) 264 (1977) (page 274), Hmin and Hc are expressed by approximation formulas and have almost a proportional relationship, so that there is basically no difference whether properties are determined by either Hmin or Hc. For this reason, in this invention the readily measurable "central oil film thickness (Hc)" is measured as an indicator for the "minimum oil film thickness (Hmin)", and the characteristics of the base oils and lubricating compositions are expressed by means of the "central oil film thickness (Hc)".

The method of measuring the oil film thickness adopted in this invention is the method of computing the EHL oil film thickness by means of optical interferometry. The basic principles of the measurements are as follows.

White light is radiated from above onto the leading edge (centre) of a contact steel ball in point contact below a rotating glass disc. Part of this white light is reflected back by a chrome layer which is coated on the glass disc, and the rest of the light travels through a silica layer and the oil film, and returns by reflecting on the steel ball. The interference stripes thereby produced are taken to a computer via a spectrometer and a high-resolution CCD camera, and the oil film thickness is thus computed.

The film thickness obtained in this method of measurement is the thickness of the centre of the contact area (central oil film thickness), and consequently the "pressure-viscosity coefficient" is calculated from Formula (I) described below.

Suitable base oils for use in this invention as the base oil (A) for use in lubricating compositions for high-speed main spindles are those in which the PV value calculated from the maximum load (P) and the maximum number of rotations (V) in the undermentioned Formula (I) as obtained in Shell 4-ball extreme pressure tests using ceramic balls is not less than $50\times10^4$ and preferably not less than $55\times10^4$. The method of calculating the PV value is described below.

$$PV\text{ value}=(P)\times(V) \quad \text{(I)}$$

As preferred instances for the base oil (A) used in this invention, mention may be made of highly refined naphthene-based base oils. In general, instances with a naphthene component (% CN) of from 30 to 50 are called naphthene-based base oils, but for the highly refined naphthene-based base oils used in this invention it is possible to use those which are naphthene-based base oils which are further refined and so have the naphthene component (% CN) and the aromatics component (% CA) adjusted to within the previously mentioned ranges. The method of refining is one which has as its objective not only removal of the sulphur component and other impurities but also the cracking and removal of the aromatics component. There are situations where solvent refining and so on will do, but hydrorefining is preferred. It is preferable if the hydrorefining goes through stages of hydrocracking, vacuum distillation, solvent dewaxing and hydrofinishing.

Hydrorefined naphthene-based base oils are those with a lowered % CA, by virtue of the hydrorefining. As the % CN, % CA and % CP of such hydrorefined naphthene-based base oils fall within the aforementioned ranges, it is preferable to use base oils of such composition as the base oils of this invention.

The base oil (A) where the % CN, % CA and % CP fall within the aforementioned ranges as in the aforementioned hydrorefined naphthene-based base oils is used in an amount such that it forms the main constituent as material for the lubricating composition of this invention. The blend proportion of the aforementioned base oil (A) in the lubricating composition of this invention is not specially limited. It is used in the proportion of being the rest after incorporating the amounts of the various additive components described below, but it is desirable if the blend proportion on the basis of the total amount of the lubricating composition is from 70 to 99.5% by mass and preferably from 75 to 92% by mass. The aromatic component in ordinary naphthene-based base oils reflected by the % CA value tends to include many kinds of aromatics such as monocyclic, Bicyclic and tricyclic, and there is a wide molecular weight distribution. Therefore, these components are removed as far as possible, and an alkyl naphthalene for which the properties can be newly specified is added separately, so that a lubricating composition with a stable performance can be ensured.

The alkyl naphthalenes (C) incorporated in the lubricating composition of this invention are those used as synthetic base oils. An alkyl naphthalene is an aromatic component, but it is possible to improve performance and characteristics of the lubricating composition by blending in a small amount as an additive so that the aromatic component (% CA) is 0 to 10 relative to the base oil.

For the alkyl naphthalenes (C) incorporated in the lubricating composition of this invention it is preferable to use those with, for example, a density at 15° C. of 0.908 g/cm$^3$, kinematic viscosity at 40° C. of 29 mm$^2$/s, kinematic viscosity at 100° C. of 47 mm$^2$/s, and viscosity index of 74. The aforementioned alkyl naphthalenes (C) are incorporated within the range 0 to 10% by mass but preferably 0 to 5% by mass in terms of the total amount of the lubricating composition.

As examples of the hydroxyl group-added poly(meth)acrylates (B) incorporated in the lubricating composition of this invention, mention may be made of non-dispersant type viscosity index improvers such as polymethacrylates or olefin polymers such as ethylene-propylene co-polymers, styrene-diene copolymers, polyisobutylene and polystyrene, and dispersant-type viscosity index improvers in which nitrogen-containing monomers are copolymerised with these. The average molecular weight is in the extremely wide range of 10,000 to 1,500,000, and as regards the molecular structure there are two types: the non-dispersant and the dispersant types. The dispersant type has polar groups, and imparts oil film forming properties and detergent-dispersant properties.

The hydroxyl group-added poly(meth)acrylates (B) incorporated in the lubricating composition of this invention are copolymers, and are copolymers wherein the essential constituent monomers are alkyl(meth)acrylates having alkyl groups of 1 to 20 carbons and vinyl monomers containing hydroxyl groups.

As specific examples of the aforementioned alkyl(meth) acrylates (a) having alkyl groups with 1 to 20 carbons, mention may be made of (a1) alkyl(meth)acrylates having alkyl groups with 1 to 4 carbons:

For example, methyl(meth)acrylate, ethyl(meth)acrylate, n- or iso-propyl(meth)acrylate, n-, iso- or sec-butyl(meth) acrylate;

(a2) alkyl(meth)acrylates having alkyl groups with 8 to 20 carbons:

For example, n-octyl(meth)acrylate, 2-ethylhexyl(meth) acrylate, n-decyl(meth)acrylate, n-isodecyl(meth)acrylate, n-undecyl(meth)acrylate, n-dodecyl(meth)acrylate, 2-methylundecyl(meth)acrylate, n-tridecyl(meth)acrylate, 2-methyldodecyl(meth)acrylate, n-tetradecyl(meth)acrylate, 2-methyltridecyl(meth)acrylate, n-pentadecyl(meth)acrylate, 2-methyltetradecyl(meth)acrylate, n-hexadecyl(meth) acrylate, and n-octadecyl(meth)acrylate, n-eicosyl(meth) acrylate, n-docosyl(meth)acrylate, methacrylate of Dobanol 23 [mixture of C-12/C-13 oxoalcohols made by Mitsubishi Chemical (Ltd.)] and methacrylate of Dobanol 45 [mixture of C-13/C-14 oxoalcohols made by Mitsubishi Chemical Company Ltd.];

(a3) alkyl(meth)acrylates having alkyl groups with 5 to 7 carbons:

For example, n-pentyl(meth)acrylate and n-hexyl(meth) acrylate.

Of the aforementioned (a1)-(a3), the preferred substances are those belonging to (a1) and (a2), and (a2) is further preferred. Also, the preferred substances of the aforementioned (a1), from the standpoint of the viscosity index, are those with 1 to 2 carbons in the alkyl groups. The preferred substances of the aforementioned (a2), from the standpoint of solubility in the base oil and low-temperature characteristics, are those with 10 to 20 carbons in the alkyl groups, and further preferred are those with 12 to 14 carbons.

The aforementioned vinyl monomers (b) containing hydroxyl groups which constitute the copolymers with the alkyl(meth)acrylates having alkyl groups of 1 to 20 carbons are vinyl monomers containing one or more than one hydroxyl group (preferably one or two) in their molecules. As specific examples mention may be made of (b1) hydroxyalkyl (2 to 6 carbons) (meth)acrylates:

For example, 2-hydroxyethyl(meth)acrylate, 2 or 3-hydroxypropyl(meth)acrylate, 2-hydroxybutyl(meth)acrylate, 1-methyl-2-hydroxyethyl(meth)acrylate;

(b2) mono or di-hydroxyalkyl (1 to 4 carbons) substituted (meth)acrylamides:

For example, N,N-dihydroxymethyl(meth)acrylamide, N,N-dihydroxypropyl(meth)acryl amide, N—N-di-2-hydroxybutyl(meth)acrylamide;

(b3) vinyl alcohols (formed by hydrolysis of vinyl acetate units);

(b4) alkenols of 3 to 12 carbons:

For example, (meth)allyl alcohol, crotyl alcohol, isocrotyl alcohol, 1-octenol, 1-undecenol;

(b5) alkenediols of 4 to 12 carbons:

For example, 1-buten-3-ol, 2-buten-1-ol, 2-butene-1,4-diol;

(b6) hydroxyalkyl (1 to 6 carbons) alkenyl (3 to 10 carbons) ethers:

For example, 2-hydroxyethylpropenyl ether;

(b7) aromatic monomers containing hydroxyl groups:

For example, o-, m- or p-hydroxystyrene;

(b8) polyhydric (from trihydric to octahydric) alcohols:

For example: alkane polyols, intramolecular or intermolecular dehydrates thereof, alkenyl (3-10 carbons) ethers of sugars (e.g. glycerine, pentaerythritol, sorbitol, sorbitan, diglycerine, sucrose) or (meth)acrylates of sugars (e.g. sucrose (meth)allyl ether);

(b9) vinyl monomers containing hydroxyl groups and polyoxyalkylene chains:

For example: mono(meth)acrylates or mono(meth)allyl ethers of polyoxyalkylene glycols (alkylene group of from 2 to 4 carbons, degree of polymerisation from 2 to 50) or polyoxyalkylene polyols {polyoxyalkylene ethers (alkyl groups of from 2 to 4 carbons, degree of polymerisation from 2 to 100) of the aforementioned trihydric to octahydric alcohols} {e.g. polyethylene glycol (degree of polymerisation from 2 to 9) mono(meth)acrylates, polypropylene glycol (degree of polymerisation from 2 to 12) mono(meth)acrylates, polypropylene glycol (degree of polymerisation from 2 to 30) mono(meth)allyl ethers}.

Of the above mentioned (b1) to (b9), from the standpoint of effect of improving the viscosity index the preferred type is (b1), and 2-hydroxy-ethyl methacrylate in particular.

The respective proportions in monomers constituting the aforementioned copolymers of poly(meth)acrylates containing hydroxyl groups are preferably, from the standpoint of the viscosity index, as follows.

The lower limit of the aforementioned constituent (a) is preferably 50% by mass but more preferably 75% by mass. The upper limit is preferably 95% by mass but more preferably 85% by mass.

The lower limit of the aforementioned (a1) is preferably 0% by mass and more preferably 1% by mass. The upper limit is preferably 20% by mass and more preferably 10% by mass.

The lower limit of the aforementioned (a2) is preferably 50% by mass and more preferably 70% by mass. The upper limit is preferably 95% by mass and more preferably 90% by mass.

The lower limit of the aforementioned (b) is preferably 5% by mass and more preferably 7% by mass, but especially preferable is 11% by mass. The upper limit is preferably 50% by mass and more preferably 30% by mass, but especially preferable is 15% by mass.

The lower limit of the total of the aforementioned (a)+(b) is preferably 55% by mass and more preferably 82% by mass. The upper limit is preferably 100% by mass.

The hydroxyl number of the poly(meth)acrylates containing hydroxyl groups (B) incorporated in the lubricating composition of this invention as an additive is 10 to 100, but preferably 20 to 50 and more preferably 25 to 35. Measurement of the hydroxyl number denotes the number obtained by measuring in accordance with JIS K3342 (1961), and it shows the amount of hydroxyl groups in an additive.

For the hydroxyl group-added poly(meth)acrylates (B) incorporated in the lubricating composition of this invention it is preferable to use those with, for example, molecular weight of approximately 17000 and hydroxyl number of approximately 28.

The phosphorus-containing carboxylic acid compounds (D) incorporated in the lubricating composition of this invention are esters of dithiophosphates or derivatives thereof and examples thereof are the following.

Dithiophosphate monoalkyl esters (the alkyl groups may be linear or branched) such as monopropyl dithiophosphate, monobutyl dithiophosphate, monoheptyl dithiophosphate, monohexyl dithiophosphate, monoheptyl dithiophosphate, monooctyl dithiophosphate and monolauryl dithiophosphate; dithiophosphate mono((alkyl)aryl) esters such as monophenyl dithiophosphate and monocresyl dithiophosphate; dithiophosphate dialkyl esters (the alkyl groups may be linear or branched) such as dipropyl dithiophosphate, dibutyl dithiophosphate, dipentyl dithiophosphate, dihexyl dithiophosphate, diheptyl dithiophosphate, dioctyl dithiophosphate and dilauryl dithiophosphate; dithiophosphate di((alkyl)aryl)esters such as diphenyl dithiophosphate and dicresyl dithiophosphate; dithiophosphate trialkyl esters (the alkyl groups may be linear or branched) such as tripropyl dithiophosphate, tributyl dithiophosphate, tripentyl dithiophosphate, trihexyl dithiophosphate, triheptyl dithiophosphate, trioctyl dithiophosphate and trilauryl dithiophosphate; and dithiophosphate tri((alkyl)aryl) esters such as triphenyl dithiophosphate and tricresyl dithiophosphate.

The phosphorus-containing carboxylic acid compounds should include carboxylic groups and phosphorus atoms in the same molecules. There is no special restriction on their structure. However, from the standpoint of extreme-pressure properties and thermal and oxidative stability, phosphorylated carboxylic acids or phosphorylated carboxylic acid esters are preferred.

As examples of phosphorylated carboxylic acids and phosphorylated carboxylic acid esters mention may be made of compounds that can be expressed by the following Chemical Formula 1.

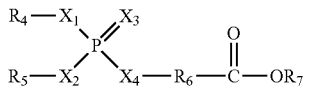

(1)

In Chemical Formula 1, $R_4$ and $R_5$ may be the same or different, and denote respectively a hydrogen atom or a hydrocarbon group with from 1 to 30 carbons, $R_6$ denotes an alkylene group with from 1 to 20 carbons, and $R_7$ denotes a hydrogen atom or a hydrocarbon group with from 1 to 30 carbons. $X_1$, $X_2$, $X_3$ and $X_4$ may be the same or different, and each denotes an oxygen atom or a sulphur atom.

In the aforementioned Chemical Formula 1, $R_4$ and $R_5$ denote respectively a hydrogen atom or a hydrocarbon group with from 1 to 30 carbons, and as examples of the hydrocarbon group of from 1 to 30 carbons mention may be made of alkyl groups, alkenyl groups, aryl groups, alkylaryl groups and arylalkyl groups.

The aforementioned phosphorylated carboxylic acids include those which have the structure of Chemical Formula 2 below, being the useful β-dithiophosphorylated propionic acids.

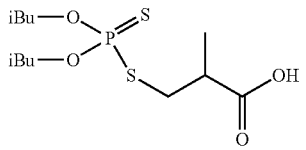

(2)

As a specific example of these 3-dithiophosphorylated propionic acids mention may be made of 3-(di-isobutoxy-thiophosphorylsuphanyl)-2-methyl-propionic acid.

The amount of phosphorus-containing carboxylic acid compounds in the lubricating composition is not specially restricted, but, in terms of the total amount of the lubricating composition, is preferably 0.001 to 1% by mass, and more preferably 0.002 to 0.5% by mass.

If the phosphorus-containing carboxylic acid compounds are below the above mentioned lower limit, there will be a tendency for adequate lubrication characteristics not to be achieved, whilst even if they exceed the above mentioned upper limit, there will be a tendency for the effect of improving the lubrication characteristics not to correspond with the amount used. In addition, there is a risk that the thermal and oxidative stability and the hydrolytic stability will decrease, which is not desirable.

Phosphorus compounds apart from the aforementioned phosphorus-containing carboxylic acids may also be used, given that they excel because of their performance elements such as extreme-pressure properties. Phosphate esters, acidic phosphate esters, amine salts of acidic phosphate esters, chlorinated phosphate esters, phosphite esters and phosphorothionates are preferred, phosphate esters are more preferred, and triaryl phosphates such as triphenyl phosphate, tricresyl phosphate, monocresyl diphenyl phosphate and dicresyl monophenyl phosphate are further preferred.

The amount of the aforementioned phosphorus-containing compounds is not specially restricted, but, in terms of the total amount of the lubricating composition, is preferably 0.01 to 5% by mass, more preferably 0.01 to 1% by mass, even more preferably 0.01 to 0.5% by mass and yet more preferably 0.01 to 0.3% by mass. If the amount of phosphorus-containing compound exceeds 0.3% by mass there is a risk that the thermal and oxidative stability will be reduced.

Apart from the aforementioned constituents (A) to (D), it is possible to blend with the lubricating composition of this invention the lubricating composition additives generally used as additives for use in lubricating compositions. For example mention may be made of ordinary anti-oxidants, metal deactivators, oiliness improvers, defoamers, rust inhibitors, demulsifiers and other known lubricating composition additives.

As examples of the anti-oxidants that may be used in this invention mention may made of amine-based anti-oxidants, phenol-based anti-oxidants, sulphur-based anti-oxidants and phosphorus-based anti-oxidants. These anti-oxidants may be used as they are in the forms used in practice in normal lubricating compositions. These anti-oxidants may be used alone or in plural combinations in the range 0.01 to 5% by mass in terms of the total amount of the lubricating composition.

As examples of the metal deactivators that may be used in this invention mention may made of benzotriazole derivatives, benzoimidazole derivatives, benzothiazole derivatives, benzooxazole derivatives, thiadiazole derivatives and triazole derivatives. These metal deactivators may be used alone or in plural combinations in the range 0.01 to 0.5% by mass in terms of the total amount of the lubricating composition.

As examples of oiliness improvers that may be used in this invention, it is possible for example to blend in fatty acid esters of polyhydric alcohols. For example, it is possible to use partial or complete 1 to 24-carbon saturated or unsaturated fatty acid esters of polyhydric alcohols such as glycerols, sorbitols, alkylene glycols, neopentyl glycols, trimethylolpropanes, pentaerythritols and xylitols. These oiliness improvers may be used alone or in plural combinations in the range 0.01 to 5% by mass in terms of the total amount of the lubricating composition.

As examples of defoaming agents that may be used to impart defoaming characteristics in this invention, mention may be made of organosilicates such as dimethylpolysiloxanes, diethyl silicates and fluorosilicones and non-silicone-based defoaming agents such as polyalkylacrylates. These defoaming agents may be used alone or in plural combinations in the range 0.0001 to 0.1% by mass in terms of the total amount of the lubricating composition.

For the rust inhibitors used in this invention it is possible to use, for example, at least one kind of additive selected from acid amides, sarcosinic acids, aspartic acid derivatives or succinic acid derivatives having mainly a rust inhibiting effect. These rust inhibitors may be used alone or in plural combinations within the range 0.01 to 0.1% by mass in terms of the total amount of the lubricating composition.

Suitable examples of the aforementioned acid amides are acid amide compounds in which saturated monocarboxylic acids of 12 to 30 carbons or unsaturated monocarboxylic acids of 18 to 24 carbons have been reacted with amines, and mention may be made of such as lauric acid amide, myristic acid amide, palmitic acid amide, stearic acid amide, isostearic acid amide and oleic acid amide. Polyalkylpolyamides obtained by reaction with polyalkylamines, for example carboxylic acid amides such as isostearic acid triethylene tetramide, isostearic acid tetraethylene pentamide, isostearic acid pentaethylene hexamide, oleic acid diethylene triamide and oleic acid diethanolamide, may also be suitably used.

The aforementioned sarcosinic acids are derivatives of glycine as shown in the undermentioned Chemical Formula (3).

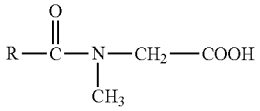

(3)

In the aforementioned Chemical Formula 3, R denotes a 1 to 30-carbon linear or branched alkyl group or alkenyl group.

As a specific example of the aforementioned sarcosinic acids, mention may be made of (Z)—N-methyl-N-(1-oxo-9-octadecenyl) glycine as in the undermentioned Chemical Formula (4).

(4)

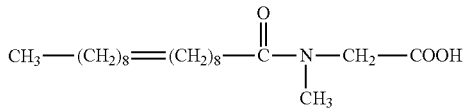

The aforementioned aspartic acid derivatives are those shown by the undermentioned Chemical Formula (5).

(5)

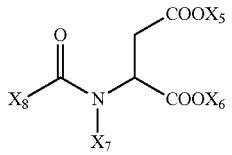

In the aforementioned Chemical Formula 5, $X_5$ and $X_6$ are each hydrogen or 3 to 6-carbon alkyl groups or hydroxyalkyl groups which may be the same or different. More preferable is if they are respectively a 2-methylpropyl group or a tertiary-butyl group.

$X_7$ is a 1 to 30-carbon alkyl group or an alkyl group having ether bonds or a hydroxyalkyl group. Good examples are where it is an octadecyl group, an alkoxypropyl group, or a 3-hydrocarbon oxyalkyl group in which the number of carbons of the hydrocarbon is 6 to 18 and the number of carbons of the alkyl group is 3 to 6, and more preferably it is a cyclohexyloxypropyl group, a 3-octyloxypropyl group, a 3-isooctyloxypropyl group, a 3-decyloxypropyl group, a 3-isodecyloxypropyl group, a 3-dodecyloxypropyl group, a 3-tetradecyloxypropyl group or a 3-hexadecyloxypropyl group.

$X_8$ is a saturated or unsaturated carboxylic acid group comprising 1 to 30 carbon atoms, or a 1 to 30-carbon alkyl group or an alkenyl group or a hydroxyalkyl group. For example, a propionic acid group or a propionylic acid group is good.

The aforementioned aspartic acid derivatives should have an acid value as determined by JIS K2501 of 10 to 200 mgKOH/g, but more preferably 50 to 150 mgKOH/g. The aspartic acid derivative is used in the amount of approximately 0.001 to 5% by mass, but preferably approximately 0.01 to 2% by mass, in terms of the total amount of the lubricating composition.

The aforementioned succinic acid derivatives are those shown by the undermentioned Chemical Formula (6).

(6)

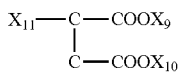

In the aforementioned Chemical Formula 6, $X_9$ and $X_{10}$ are each hydrogen or 3 to 6-carbon alkyl groups or alkenyl groups or hydroxyalkyl groups which may be the same or different. Preferably they are hydrogen atoms, 1-hydroxypropyl groups, 2-hydroxypropyl groups, 2-methylpropyl groups or tertiary-butyl groups. $X_{11}$ is a 1 to 30-carbon alkyl group or alkenyl group, or an alkyl group having ether bonds, or a hydroxyalkyl group. Good examples are a methyl group, an ethyl group, a propyl group, a butyl group, a pentyl group, a hexyl group, a heptyl group, an octyl group, a 2-ethylhexyl group, a nonyl group, a decyl group, an undecyl group, a dodecyl group, a dodecylene group, a tridecyl group, a tetradecyl group, a tetradecylene group, a pentadecyl group, a hexadecyl group, a heptadecyl group, an octadecyl group, an octadecylene group, an eicosyl group, a docosyl group, an alkoxypropyl group, a 3-($C_6$~$C_{18}$) hydrocarbonoxy($C_3$~$C_6$) alkyl group, an alkoxypropyl group, a 3-($C_6$~$C_{18}$) hydrocarbonoxy($C_3$~$C_6$) alkyl group, and more preferable are a tetraisopropyl group, an oleyl group, a cyclohexyl oxypropyl group, a 3-octyloxypropyl group, a 3-isooctyloxypropyl group, a 3-decyloxypropyl group, a 3-isodecyloxypropyl group, and a 3-($C_{12}$~$C_{16}$) alkoxypropyl group. Aminated forms of these compounds are also good.

The aforementioned succinic acid derivatives typically have an acid value as determined by JIS K2501 of 10 to 300 mgKOH/g, but more preferably 30 to 200 mgKOH/g. The succinic acid derivative is used in the amount of approximately 0.001 to 5% by mass, but preferably approximately 0.001 to 4.5% by mass, and more preferably approximately 0.005 to 4% by mass, in terms of the total amount of the lubricating composition. These succinic acid derivatives may be used as one kind or as mixtures of several kinds.

The amount of the aforementioned acid amides, sarcosinic acids, aspartic acid derivatives and succinic acid derivatives is not specially limited, but, in terms of the total amount of the lubricating composition, is 0.001 to 5% by mass, preferably 0.001 to 4.5% by mass, more preferably 0.01 to 4% by mass, even more preferably 0.02 to 3.5% by mass, and yet more preferably 0.05 to 3% by mass. If the amount thereof is less than 0.001% by mass, there is a risk that the prevention of corrosion will be inadequate, whilst if it exceeds 5% by mass, there is a risk that the demulsification and foaming properties will be reduced.

The demulsifiers that can be used in this invention may be those of the prior art used as normal lubricating composition additives, for example polyoxyethylene-polyoxypropylene condensates, reverse forms of polyoxyethylene-polyoxypropylene block polymers, and ethylenediamine polyoxyethylene-polyoxypropylene block polymers. As to the amount thereof added, they may be used in the range, in terms of the total amount of the lubricating composition, of 0.0005 to 0.5% by mass.

By virtue of the fact that the lubricating composition of this invention contains the aforementioned base oil (A) and a hydroxyl group-added poly(meth)acrylate (B), or by virtue of the fact that it further contains either an alkyl naphthalene (C) or a phosphorus-containing carboxylic acid compound (D) or both, a lubricating composition is obtained which has the characteristics that the minimum oil film thickness is large, the pressure-viscosity coefficient is high and the pressure-velocity product (PV value) is high.

What is meant here by saying that the minimum oil film thickness is large is that the minimum oil film thickness in a system of rolling contact or rolling-sliding contact where a load (weight) is applied is large. Also, saying that the pressure-viscosity coefficient is high means that in a system where a load (weight) is applied, the viscosity is high when the pressure in the form of the load (weight) increases, and by virtue of this the aforementioned minimum oil film thickness can be maintained in a large state.

Also, the pressure-velocity product is the product of the pressure (weight) in the form of the load and the velocity corresponding to the sliding, and is expressed as the PV value already mentioned. What is then meant by saying that the pressure-velocity product is high is that, in a sliding contact system in the boundary lubrication domain where the pressures and/or velocities are large, the extreme-pressure properties (EP properties) are high and have high anti-seizure load performance.

For this reason, if the lubricating composition of this invention is used as a lubricating composition for use in rolling contact or rolling-sliding contact systems such as roller bearings or gears, an EHL (elastohydrodynamic lubrication) oil film will be formed and interference between protuberances on sliding surfaces can be prevented. In particular, if the lubricating composition of this invention is used in rolling contact or rolling-sliding contact systems where a load (weight) is applied, the EHL oil film will be formed, and interference between protuberances on sliding surfaces can be prevented, even when the load (weight) is applied.

By virtue of the fact that the lubricating composition of this invention contains a base oil (A) and a hydroxyl group-added poly(meth)acrylate (B), or by virtue of the fact that it further contains either an alkyl naphthalene (C) or a phosphorus-containing carboxylic acid compound (D) or both, it is possible to obtain, as a lubricating composition for use in rolling contact or rolling and sliding contact systems such as roller bearings and gears, and in particular a lubricating composition for use in rolling contact or rolling and sliding contact systems where a load (weight) is applied, a lubricating composition which has a large minimum oil film thickness, a high pressure-viscosity coefficient and a large pressure-velocity product (PV value).

The invention is explained in specific detail below by means of Examples and Comparative Examples, but the invention is not limited to only these Examples.

EXAMPLES

The base oil and additives used in Examples 1 to 4 and Comparative Examples 1 to 4 were as follows.

Base Oil (A): Hydrorefined Naphthene-Based Base Oil
- % CN: 40, % CA: 0, % CP: 60.
- Molecular weight: 408
- Density @ 20° C.: 0.865 g/cm$^3$
- Kinematic viscosity @ 40° C.: 34.0 mm$^2$/s
- Kinematic viscosity @ 100° C.: 5.56 mm$^2$/s
- Viscosity index: 100

Hydroxyl Group-Added Poly(Meth)Acrylate (B):
- Product name: Aclube V-1070 (manufactured by Sanyo Chemical Co. Ltd.)
- Molecular weight: approx. 17000
- Hydroxyl number: approx. 28.5

Alkyl Naphthalene (C):
- Product name: Synesstic 5 (manufactured by ExxonMobil Ltd.; trade name)
- Density @ 15° C.: 0.908 g/cm$^3$
- Kinematic viscosity @ 40° C.: 29 mm$^2$/s
- Kinematic viscosity @ 100° C.: 47 mm$^2$/s
- Viscosity index: 74

Phosphorus-Containing Carboxylic Acid Compound (D): β-dithiophosphorylated Carboxylic Acid
- Density @ 20° C.: 1.104 g/cm$^3$
- Acid number: 167 mgKOH/g
- Sulphur content: 19.8% by mass
- Phosphorus content: 9.3% by mass Comparative Example 5 used a commercial product (Mobil DTE Light, manufactured by ExxonMobil Ltd; trade name).

The categories of measurement and the methods of measurement of the constituents in the Examples and Comparative Examples were as follows.

(1) % CN: Naphthene-based constituent carbon ratio (%) in accordance with ASTM-D-3238

(2) % CA: Aromatics-based constituent carbon ratio (%) in accordance with ASTM-D-3238

(3) % CP: Paraffin-based constituent carbon ratio (%) in accordance with ASTM-D-3238

The categories of measurement and the methods of measurement of the properties in the Examples and Comparative Examples were as follows.

(1) Density: Density at 15° C. (g/cm$^3$) in accordance with JIS-K-2249

(2) Kinematic viscosity at 40° C. (Vk40): Kinematic viscosity at 40° C. (mm$^2$/s) in accordance with JIS-K-2283

(3) Kinematic viscosity (Vk100): Kinematic viscosity at 100° C. (mm$^2$/s) in accordance with JIS-K-2283

(4) Viscosity index: Viscosity index in accordance with JIS-K-2283

(5) Number average molecular weight: Number average molecular weight in accordance with ASTM-D-3238

By way of evaluation of the lubrication properties of the ceramic and steel balls, a Shell 4-ball extreme-pressure test and a Shell 4-ball wear test were carried out as described below.

Shell 4-Ball Extreme Pressure Test (EP Test)

Test balls: The rotating ball was made of a ceramic ($Si_3N_4$) and the fixed balls were made of bearing steel (SJ-2).

Load (P): 40 to 75 kgf (392 to 735 N)

Number of rotations (V): 10,000 min$^{-1}$

Duration of test: 30 seconds

Temperature: Room temperature

Measurement: The test load was increased in segments of 5 kgf, and the maximum load (P) and maximum speed (V) at which seizing did not occur for 30 seconds were obtained. The PV value. was calculated from these values by means of the following Formula (I). An assessment can be made that oils with a higher PV value have better extreme pressure-resisting properties.

$$PV\ \text{value}=(P)\times(V) \quad \text{(I)}$$

The method of measurement of the examples of embodiment follows the ASTM method of measurement, but the measurement is so done that, in conformity with the application (operating conditions) of the lubricating composition used, the test conditions are varied so as to increase the relationship with actual machines as far as practicable. Comparison with the ASTM method of measurement is as shown in Table 1 below.

TABLE 1

| Test conditions | | ASTM D2783 | Method of this Invention |
|---|---|---|---|
| Test bearing | Fixed balls | Bearing steel (SUJ2) | Bearing steel (SUJ2) |
| | Rotating ball | Bearing steel (SUJ2) | Ceramic balls ($Si_3N_4$) |
| Speed min$^{-1}$ | | 1760 | 10,000 |
| Load kgf (N) | | Any | Any |
| Test duration sec | | 10 | 30 |
| Test oil temperature ° C. | | Room temperature | Room temperature |
| Categories measured | | LNL, WL, LWI | Maximum non-seizure PV value |

Notes to Table 1:
LNL: Last Non-seizure Load
WL: Welding Load
LWI: Load Wear Index Maximum non-seizure PV value: calculated by means of the aforementioned Formula (II) from the last non-seizure load (P) and the speed (V).

(With all these indicative values, the higher they are the better the extreme pressure (EP) properties.)

In Table 1, the "load" goes up in steps and in the tests to obtain the seizure limit loads, the seizure load varies considerably according to the lubricating composition, and so has been designated as "any".

As to the characteristics of the lubricating compositions in the Examples and the Comparative Examples, a Shell 4-ball wear test was carried out in accordance with the test method standardised in ASTM D 4172, and the lubrication properties of each lubricating composition were evaluated. Previous Shell 4-ball wear tests have been carried out with test conditions of a comparatively low number of revolutions (sliding velocity) of 1200 $min^{-1}$ to 1800 $min^{-1}$, but in consideration of actual conditions of use the more rigorous test conditions given below were applied. The rate of increase of the measured oil temperature, the maximum torque, the friction coefficient and the fixed ball wear mark diameter were used as indicators to evaluate the lubrication performance.

Shell 4-Ball Wear Test

Test balls: The rotating ball was made of a ceramic ($Si_3N_4$) and the fixed balls were made of bearing steel (SUJ-2).

Load (P): 50 kgf (=490 N)—fixed

However, in the case of Comparative Example 2, 45 kgf (seizure occurred at 50 kgf)

In the case of Comparative Example 5, 40 kgf (seizure occurred at 45 kgf)

Number of rotations (V): 10,000 $min^{-1}$

Duration of test: 30 seconds

Temperature: Room temperature (at start of test)

Measurement: In the period from the start of the test to the end, the torque maximum value (kgf·cm), the torque fluctuation value (kgf·cm) and the wear mark diameter (mm) in the SUJ-2 after completion of the test were measured.

Measurement of Oil Film Thickness:

The oil film thickness of the sample oils was measured under the following conditions by using an optical type EHL oil film thickness measuring apparatus made by PCS Instruments Ltd.

The oil film thickness of the lubricating composition is measured by means of the contact behaviour of a steel ball below a rotating glass disc. Part of the light which is radiated from above the rotating glass disc onto the area in contact with the steel ball is reflected back by a chromium film which is coated on the surface of the glass disc, and the rest of the light travels through a silica layer and the oil film, and returns by reflecting on the steel ball. The interference stripes thereby produced are taken to a computer via a spectrometer and a high-resolution CCD camera, and the oil film thickness is thus measured.

Measurement Conditions

Velocity: 0~4.4 m/s

Load: 20 N

Oil temperature: 80° C.

Calculation of Pressure-Viscosity Coefficient at 80° C.

The pressure-viscosity coefficient at 80° C. is calculated using the following formula from the central oil film thickness measured by means of the aforementioned optical type EHL oil film thickness measuring device.

The pressure-viscosity coefficient is obtained by calculation from the measured values of the central oil film thickness as shown in Hamrock, B. J, Dowson, D.: "Isothermal Elastohydrodynamic Lubrication of Point Contacts, Part III", Journal of Lubrication Technology, Transactions of ASME, 99 (April), 264 (1977).

The lubricating composition forms an EHL (elastohydrodynamic lubrication) oil film in the bearing and performs a role in preventing interference between protuberances of the sliding surfaces. The point-contact central oil film thickness (Hc: dimensionless central oil film thickness) according to Hamrock-Dowson is shown by formula (III).

$$H_C=2.69U^{0.67}G^{0.53}W^{-0.067}(1-0.61e^{-0.73k}) \quad \text{(III)}$$

k=a/b Ellipticity parameter (In the case of a true circle, k=1)

$U=u\eta_0/E'R$) Velocity parameter $W=w/(E'R^2)$ Weight parameter $G=\alpha E'$ Material parameter E': Elastic modulus of test balls R: Radius of test balls (m)

$\eta_0$: Viscosity of lubricating composition at atmospheric pressure (mPa)

u: Sliding velocity (m/s)

w: Load (N)

$\alpha$: Pressure-viscosity coefficient

The pressure-viscosity coefficient is shown by Formula (IV) from the definition formula of the material parameter of the above mentioned Formula (III).

$$\alpha=G/E' \quad \text{(IV)}$$

The material parameter "G" is calculated from the measured oil film thickness (Hc) using Formula (III). Next, the pressure-viscosity coefficient $\alpha$ is obtained by calculation from Formula (IV).

In Formula (III), focusing on the property values of the lubricating composition shows that the viscosity $\eta_0$ in the velocity parameter U and the pressure-viscosity coefficient $\alpha$ in the material parameter G are the factors which influence the central oil film thickness.

Given that the viscosity $\eta_0$ is included in the velocity parameter, the central oil thickness varies in proportion to the power of 0.67 of the viscosity, so that the greater is the atmospheric pressure viscosity at the lubricating composition temperature at the inlet of the rolling contact element, the more the oil film thickness increases, and the more the bearing life increases. In other words, it is preferable to have a small variation in viscosity in relation to temperature (high viscosity index).

In the case of the pressure-viscosity coefficient $\alpha$ included in the material parameter, the oil film thickness varies in proportion to the power of 0.53. In general, according to the Braus formula Tribologist, Vol. 53, No. 10, page 653 which shows the relationship between viscosity and pressure, the viscosity under high pressure becomes higher the higher the pressure-viscosity coefficient $\alpha$ is, so that the bearing fatigue life improves the more the lubricating composition has a large $\alpha$.

$$\eta_P=\eta_0\exp(\alpha P) \quad \text{(V)}$$

P: Pressure on lubrication surface (load)

$\eta_P$: Lubricating composition viscosity under high pressure

Examples 1 to 4

Comparative Examples 1 to 5

For Example 1 to 4 and Comparative Examples 1 to 4 lubricating compositions were prepared by blending the previously described base oil (A) and additives (B) to (D). A commercial product was used for Comparative Example 5, and the lubrication characteristics were investigated. The composition, properties and the measured values for the lubricating composition characteristics in each case are shown in Table 2.

TABLE 2

| | Example 1 | Example 2 | Example 3 | Example 4 | Comp. Ex. 1 | Comp. Ex. 2 | Comp. Ex. 3 | Comp. Ex. 4 | Comp. Ex. 5 |
|---|---|---|---|---|---|---|---|---|---|
| Base oil (A) (%) | 97.00 | 92.00 | 96.98 | 91.98 | 94.98 | 95.00 | 99.98 | 100.00 | Commercial product |
| Additive (B) (%) | 3.00 | 3.00 | 3.00 | 3.00 | 0 | 0 | 0 | 0 | |
| Additive (C) (%) | 0 | 5.00 | 0 | 5.00 | 5.00 | 5.00 | 0 | 0 | |
| Additive (D) (%) | 0 | 0 | 0.02 | 0.02 | 0.02 | 0 | 0.02 | 0 | |
| Density (g/cm$^3$) | 0.869 | 0.878 | 0.869 | 0.871 | 0.869 | 0.869 | 0.868 | 0.867 | 0.858 |
| Kinematic viscosity 40° C. (mm$^2$/s) | 35.5 | 34.9 | 35.5 | 34.9 | 33.3 | 33.4 | 33.9 | 34.0 | 30.0 |
| Kinematic viscosity 100° C. (mm$^2$/s) | 5.89 | 5.83 | 5.89 | 5.83 | 5.51 | 5.50 | 5.56 | 5.56 | 5.40 |
| Viscosity index | 108 | 109 | 108 | 109 | 101 | 100 | 100 | 100 | 115 |
| EP test PV (×10$^4$) | 50 | 60 | 50 | 70 | 50 | 45 | 50 | 50 | 40 |
| Wear test Torque maximum (kgf · cm) | 1.4 | 2.3 | 3.2 | 2.4 | 1.8 | 2.1 | 1.9 | 1.8 | 2.2 |
| Wear test Torque fluctuation (kgf · cm) | 0.9 | 1.2 | 1.0 | 1.2 | 1.1 | 1.2 | 1.1 | 1.1 | 1.5 |
| Wear test Wear mark diameter (mm) | 0.42 | 0.42 | 0.43 | 0.42 | 0.43 | 0.43 | 0.43 | 0.42 | 0.76 |
| Central oil film thickness 80° C. (nm) | 163 | 164 | 164 | 163 | 155 | 156 | 159 | 160 | 162 |
| Pressure-viscosity coefficient (average) 80° C. (GPa$^{-1}$) | 14.6 | 15.4 | 14.3 | 14.8 | 11.0 | 11.7 | 10.9 | 11.8 | 12.1 |

Table 2 shows that, if it is assumed that a pass point is a PV value of not less than 50 (×10$^4$), a central oil film thickness (80° C.) of not less than 160 nm, and a pressure-viscosity coefficient (average) at 80° C. calculated from the central oil film thickness of not less than 13 GPa$^{-1}$, the lubricating compositions of Examples 1 to 4 have reached the pass line, but Comparative Examples 1 to 5 have not reached the pass line. The base oil (A) itself of Comparative Example 4 shows good results in the Shell 4-ball wear test, but it can be seen that blending with additive (B) and either additive (C) or (D) or both shows even better results as regards characteristics such as central oil film thickness and pressure-viscosity coefficient. In other words, it can be seen that the central oil film thickness is larger, the pressure-viscosity coefficient is higher, the pressure-velocity product (PV value) is higher, and superior lubricating composition characteristics are obtained.

This invention can be used as a lubricating composition for use in rolling contact or rolling and sliding contact systems such as roller bearings and gears, and in particular as a lubricating composition for use in rolling contact or rolling and sliding contact systems where a load (weight) is applied.

We claim:

1. A method comprising:

lubricating a roller bearing with a lubricating composition that comprises:

(i) a hydrorefined naphthene-based base oil (A) in an amount of 70 to 99.5% by mass, wherein the base oil (A) has a % CA of not more than 10 and a ratio of % CN and % CP (% CN/% CP) of not less than 0.4;

(ii) a hydroxyl group-added poly(meth)acrylate (B) in an amount of 0.5 to 30% by mass; and at least one further compound selected from the group consisting of:

(iii) an alkyl naphthalene (C) in an amount up to 10% by mass; and (iv) a phosphorus-containing carboxylic acid compound (D) in an amount up to 1% by mass, wherein the phosphorus-containing carboxylic acid compound (D) has the formula 1 below,

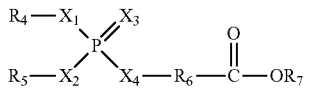

(1)

wherein $R_4$ and $R_5$ may be the same or different, and denote a hydrogen atom or a hydrocarbon group having from 1 to 30 carbons, wherein $R_6$ denotes an alkylene group having from 1 to 20 carbons, wherein $R_7$ denotes a hydrogen atom or a hydrocarbon group having from 1 to 30 carbons, and wherein $X_1$, $X_2$, $X_3$ and $X_4$ may be the same or different, and denote an oxygen atom or a sulphur atom.

2. A method in accordance with claim 1 wherein the at least one further compound is the alkyl naphthalene (C).

3. A method in accordance with claim 1 wherein the at least one further compound is the alkyl naphthalene (C) and the phosphorus-containing carboxylic acid compound (D).

4. A method in accordance with claim 1 wherein the phosphorus-containing carboxylic acid compound (D) is a β-dithiophosphorylated carboxylic acid.

* * * * *